US009295870B2

(12) United States Patent
Mikulski

(10) Patent No.: US 9,295,870 B2
(45) Date of Patent: Mar. 29, 2016

(54) PORTABLE EXERCISE SYSTEM

(71) Applicant: Walter J. Mikulski, Orlando, FL (US)

(72) Inventor: Walter J. Mikulski, Orlando, FL (US)

( * ) Notice: Subject to any disclaimer, the term of this patent is extended or adjusted under 35 U.S.C. 154(b) by 0 days.

(21) Appl. No.: 14/635,333

(22) Filed: Mar. 2, 2015

(65) Prior Publication Data

US 2015/0251039 A1 Sep. 10, 2015

Related U.S. Application Data

(60) Provisional application No. 61/966,792, filed on Mar. 4, 2014.

(51) Int. Cl.

| | |
|---|---|
| ***A63B 21/018*** | (2006.01) |
| ***A63B 21/04*** | (2006.01) |
| ***A63B 71/02*** | (2006.01) |
| ***A63B 21/055*** | (2006.01) |
| ***A63B 21/16*** | (2006.01) |
| ***A63B 23/035*** | (2006.01) |
| *A63B 17/04* | (2006.01) |

(52) U.S. Cl.

CPC ..... *A63B 21/0442* (2013.01); *A63B 21/0552* (2013.01); *A63B 21/16* (2013.01); *A63B 23/03541* (2013.01); *A63B 71/023* (2013.01); *A63B 17/04* (2013.01); *A63B 21/4035* (2015.10); *A63B 2210/50* (2013.01)

(58) Field of Classification Search

CPC .... A63B 21/0442; A63B 17/00; A63B 17/02; A63B 17/04; A63B 21/00; A63B 21/00004; A63B 21/1423; A63B 21/1426; A63B 21/143; A63B 21/1434; A63B 21/1438; A63B 21/1442; A63B 21/1465; A63B 22/048; A63B 22/0076; A63B 22/0087; A63B 2022/0079; A63B 23/035; A63B 23/0079; A63B 23/03508; A63B 21/05; A63B 21/055; A63B 21/0552; A63B 21/0555; A63B 21/0557; A63B 21/0012; A63B 21/00123; A63B 21/062; A63B 21/0623; A63B 21/0626; A63B 21/072

USPC ..... 211/196, 205, 133.4

See application file for complete search history.

(56) References Cited

U.S. PATENT DOCUMENTS

| | | | | |
|---|---|---|---|---|
| 3,992,013 | A * | 11/1976 | Golden | 473/409 |
| 5,039,105 | A * | 8/1991 | Ro | 473/258 |
| 7,896,786 | B1 * | 3/2011 | Osbourne | 482/122 |
| 8,784,284 | B1 * | 7/2014 | Smith | 482/121 |
| 2006/0084556 | A1 * | 4/2006 | Payne | 482/121 |
| 2012/0083395 | A1 * | 4/2012 | Carson | 482/129 |
| 2012/0142503 | A1 * | 6/2012 | Sevadjian et al. | 482/99 |
| 2013/0165827 | A1 * | 6/2013 | Liu | 601/137 |
| 2014/0031182 | A1 * | 1/2014 | Donofrio | 482/129 |

* cited by examiner

*Primary Examiner* — Loan H Thanh
*Assistant Examiner* — Megan Anderson
(74) *Attorney, Agent, or Firm* — Jason T. Daniel, Esq.; Daniel Law Offices, P.A.

(57) ABSTRACT

A portable exercise system includes a plurality of elongated frame members sequentially connected to form an elongated truss. A series of apertures extend a length thereof. A base unit that includes two generally L-shaped members are secured along the bottom end of the elongated truss, and a pair of resistance devices are selectively engaged to individual apertures located along the truss.

12 Claims, 8 Drawing Sheets

PORTABLE EXERCISE SYSTEM

CROSS-REFERENCE TO RELATED APPLICATIONS

This application claims the benefit of U.S. Application Ser. No. 61/966,792 filed on Mar. 4, 2014, the contents of which are incorporated herein by reference.

TECHNICAL FIELD

The present invention relates generally to portable exercise equipment, and more particularly to a collapsible and reconfigurable portable exercise assembly which can utilize various resistance elements to allow a user to perform a complete range of upper and lower body exercises while traveling or in a home environment.

BACKGROUND

The statements in this section merely provide background information related to the present disclosure and may not constitute prior art.

As our society transitions from a labor intensive society to a computer based service society, people get less and less exercise. Because of the sedentary nature of the work environment, it is important to be able to get exercise whenever and wherever possible. If a person is traveling and staying in a hotel and/or motel, being able to exercise is important to one's wellbeing. A person that is physically fit is also sharper mentally and is more productive in the work place.

Unfortunately, it is a known fact that most people do not visit the gym because they simply don't have time or won't make the time. Some people save time by investing in a home gym. In this regard, there are many different types of home exercise equipment which typically includes heavily framed items that are difficult to move and store. As such, these items are useful in a home environment, but are not portable enough to take with you on the go.

To this end, frequent travelers must often rely on the workout facilities of hotels. This can be problematic, as the range and quality of the available exercise equipment varies widely from one location to the next. As a result, many users simply skip their workouts.

Accordingly, there remains a need for a portable exercise system that includes a lightweight design that can easily fit within a suitcase, is easily assembled at any location, and that can provide a complete body workout anywhere the user is located.

SUMMARY OF THE INVENTION

The present invention is directed to a portable exercise system that is also referred to as the travelers training truss system.

One embodiment of the present invention can include a plurality of elongated frame members that are capable of being connected sequentially to form a single elongated truss. The truss can include a series of apertures extending the length thereof, and each of these apertures can be marked with a number.

A base unit that includes two general L-shaped members can be secured along the bottom end of the elongated truss. The base unit can be oriented to either a T-configuration or a V-configuration, depending on the type of exercise to be performed. A pair of resistance devices which include resistance bands, a frame connection member, and a handle are also provided.

Another embodiment of the present invention can include a rotating grooved wheel that is positioned along the handle. The wheel can glide upon the truss, and can aid in maintaining proper form during an exercise routine.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
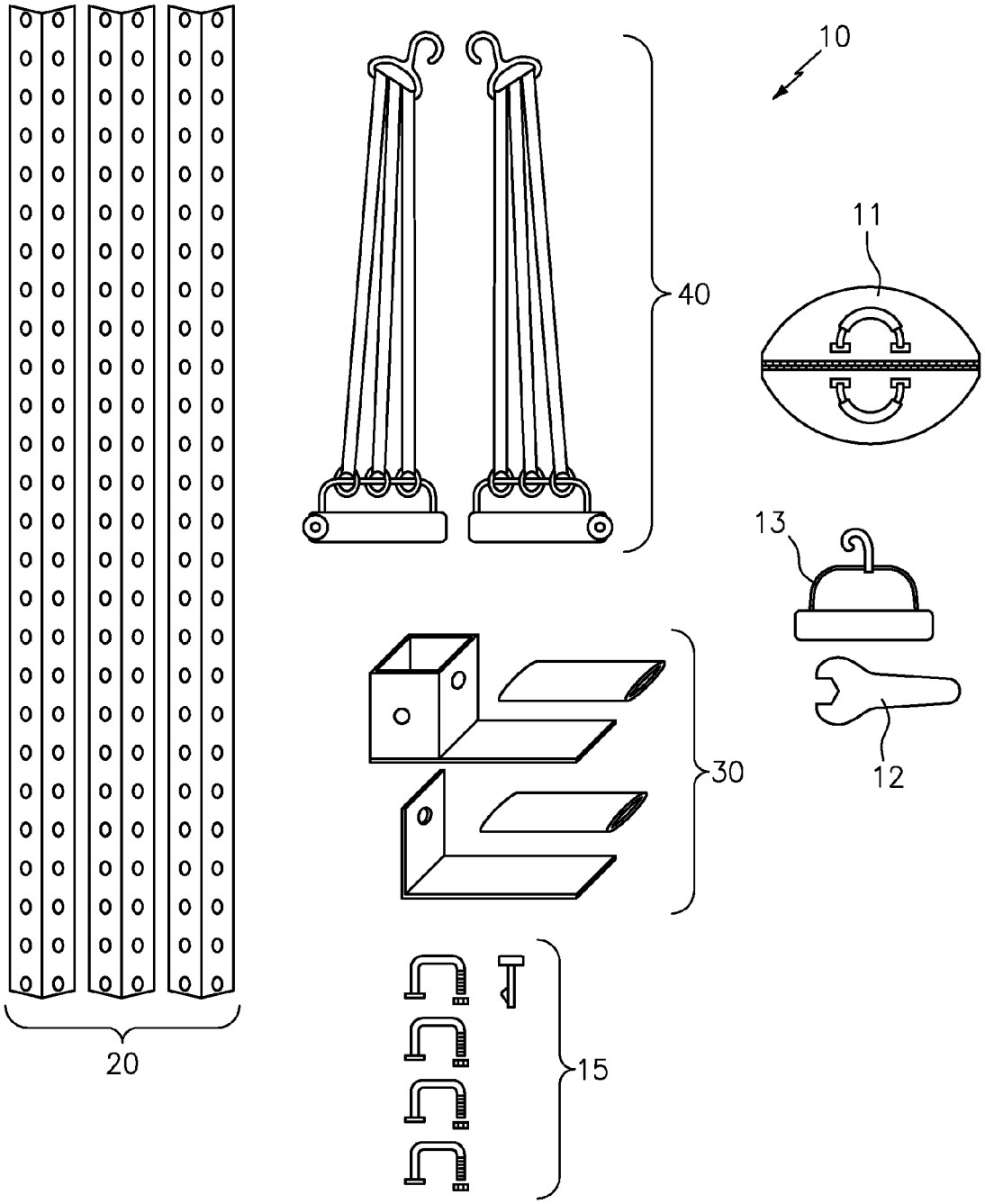
FIG. 1 is an exploded parts view of a portable exercise system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Through extensive research and development, the inventor has created a unique portable exercise system referred to hereinafter as the Travelers Training Truss System. As will be described below, the Truss system can be easily stored in a travel case that is small enough to fit inside of a suitcase for travel aboard an airliner. The system can be fully assembled in minutes utilizing standard bolt and pin hardware. The truss has the flexibility to allow a user to perform all 10 most basic upper and lower body exercises. Additionally, the truss system includes functionality for allowing the user to vary the amount of resistance used.

FIGS. 1-5 illustrate various embodiments of the training truss system 10 that are useful for understanding the inventive concepts disclosed herein. More particularly, FIG. 1 illustrates an exploded parts view of the system that includes a plurality of frame members 20, a base unit 30, a pair of resistance devices 40 and associated hardware 15.

Figure 2A:
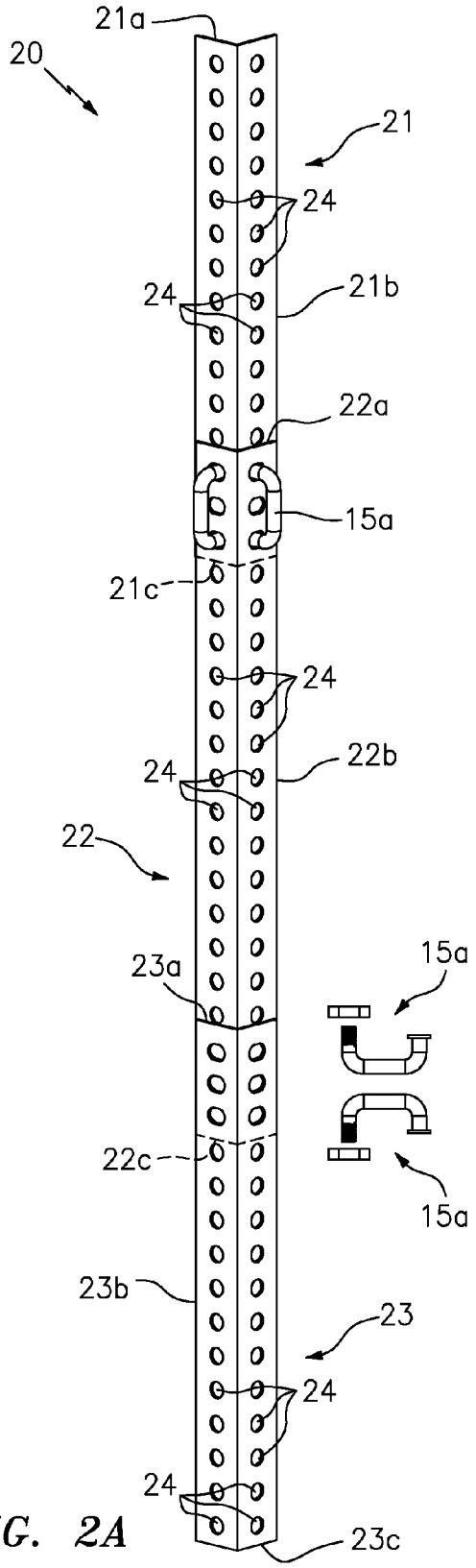
FIG. 2A is a perspective view of the frame members of the portable exercise system, in accordance with one embodiment of the invention.

As shown in FIG. 2A, the truss frame 20 can include a top frame member 21, a middle frame member 22 and a bottom frame member 23. Each of the frame members can preferably be constructed from a rigid elongated and generally L-shaped member such as steel, for example, and can further include first ends 21*a*, 22*a*, 23*a*, middle sections 21*b*, 22*b*, 23*b*, and second ends 21*c*, 22*c* and 23*c*, respectively. In one embodiment, each of the frame members can include an identical length, however other embodiments where one or more of the frame members includes a different length are also contemplated. Additionally, it is also contemplated that a different number of frame members can be provided in order to create a truss frame that is longer or shorter in length.

As will be described below, it is preferred that the side portions of each truss frame member include a smooth edge, in order to accommodate the wheel 46 of the handgrip. Such a feature allowing a user to perform single handed exercises wherein the edge of the truss can act as a rail, allowing the user to position the handle wheel over the rail track and letting the handgrip glide over the rail as the arm moves back and forth.

Positioned along the entirety of each truss member are a plurality of evenly apertures 24 which can function engage the connection hardware and the resistance devices 40 described below. Additionally, a marking such as a hardware connection symbol C or a number N, can be associated with each aperture. In the preferred embodiment, the numbers N can be listed sequentially, wherein the number 1 is located at the lowermost aperture of the bottom frame member 23, and the number 80 is located at the uppermost aperture of the top frame member 21. Of course, any number of other markings are also contemplated. Such features can function to assist a user in properly assembling the truss frame, and to allow for consistency in resistance. In this regard, by providing the plurality of marked apertures, a user is able to perform any number of different exercises using the system at a position and resistance level that is best suited for the user.

As shown, the truss frame can be assembled by aligning the truss members top to bottom so that the end portions of each respective truss member overlap one another. At this time, the connection C apertures 24 will be aligned, and the frame members can be secured together utilizing connection hardware such as the illustrated U-bolts and nuts 15*a*, for example. Of course, this is but one means for securing the frame members together, as any number of other suitable hardware components can also be utilized. Several nonlimiting examples include traditional straight bolts and nuts, and various other forms of compression fittings.

Figure 2B:
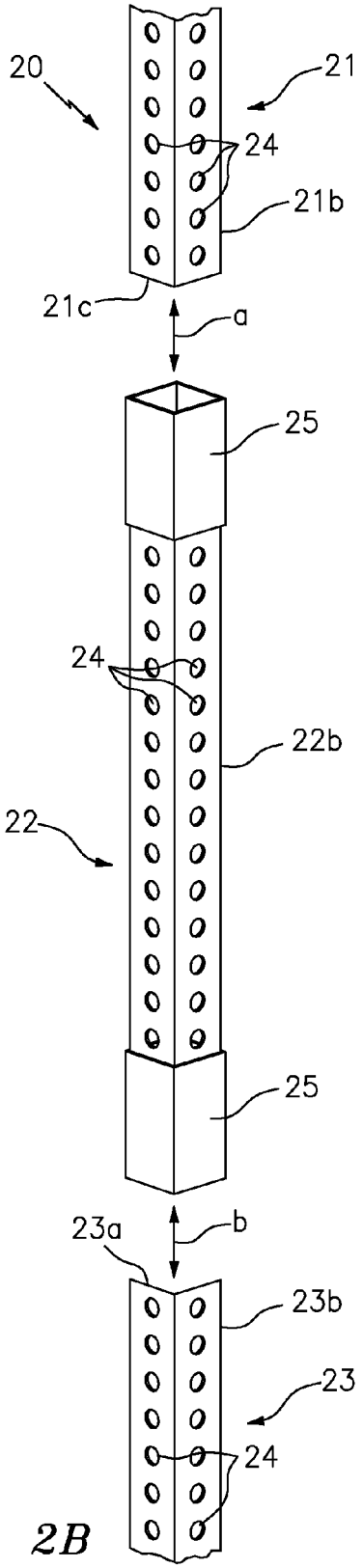
FIG. 2B is a perspective view of the frame members of the portable exercise system, in accordance with another embodiment of the invention.

FIG. 2B illustrates another embodiment of the truss frame 20 that further includes a pair of generally rectangular shaped receivers 25 that are permanently affixed along the top and bottom ends of the middle frame member 22. The receivers can function to allow the top and bottom frame members to be slid (see arrows a and b) within the receiver section when assembling the frame. In this regard, the receivers can function alone, or in combination with connection hardware through additional apertures (not illustrated) which can be provided in the receivers themselves. Such a feature can increase assembly time, and reduce the chances for incorrect assembly of the frame. In the preferred embodiment, the receivers 25 can be constructed from an identical material as the frame section, and can be integral to the construction of the same.

Figure 3:
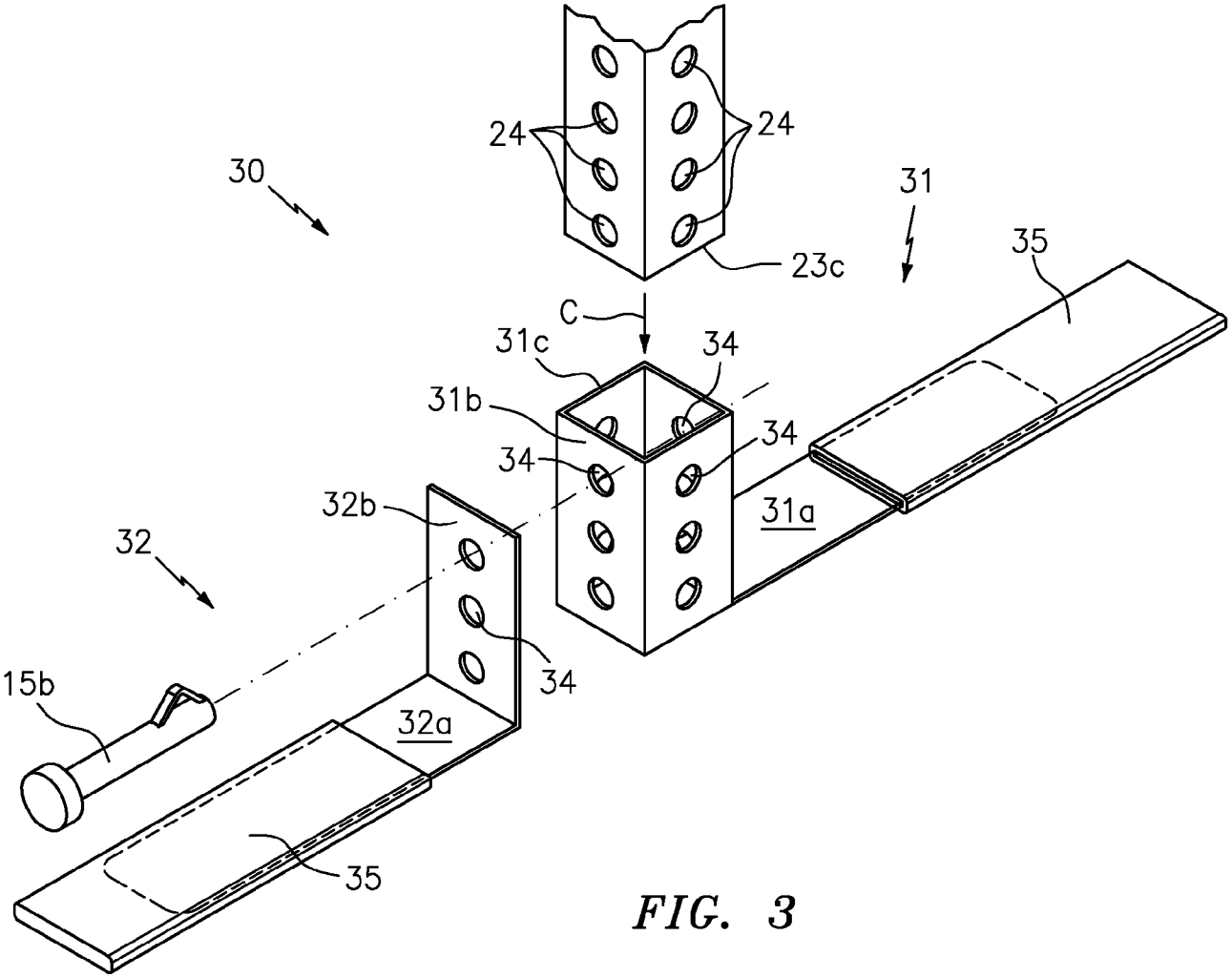
FIG. 3 is a perspective view of the base unit of the portable exercise system, in accordance with one embodiment of the invention.

The base unit functions to support the truss when in the vertical (standing) position. The base unit also serves as a body restraint when the truss is placed in the horizontal position, and finally serves as a "prop" when using a room corner as a support. As shown in FIG. 3, the base unit 30 can include a generally L-shaped receiver bracket 31 having a horizontal section 31*a*, and a plurality of vertical sections 31*b* forming a socket/pocket area 31*c* for receiving the bottom end 23*c* of the truss frame 20 (see arrow c). The base unit also includes a second generally L-shaped bracket 32 having a horizontal section 32*a* and a single vertical section 32*b*. A pair of padded covers 35 can be included with the system. The covers can include a shape and material that is suitable for being slid over the horizontal sections of the brackets 21 and 32, in order to provide a comforting surface for a device user.

As shown, a plurality of apertures 34 can be positioned along the vertical sections of the brackets 31 and 32, and can function to align the respective brackets into either a "V" (see FIG. 5) or the illustrated "T"-shaped configuration. Once the frame member is positioned within the socket area, the apertures 34 and 24 will be aligned, and can function to receive another connector such as the illustrated cotter pin 15*b*, for example.

Figure 4:
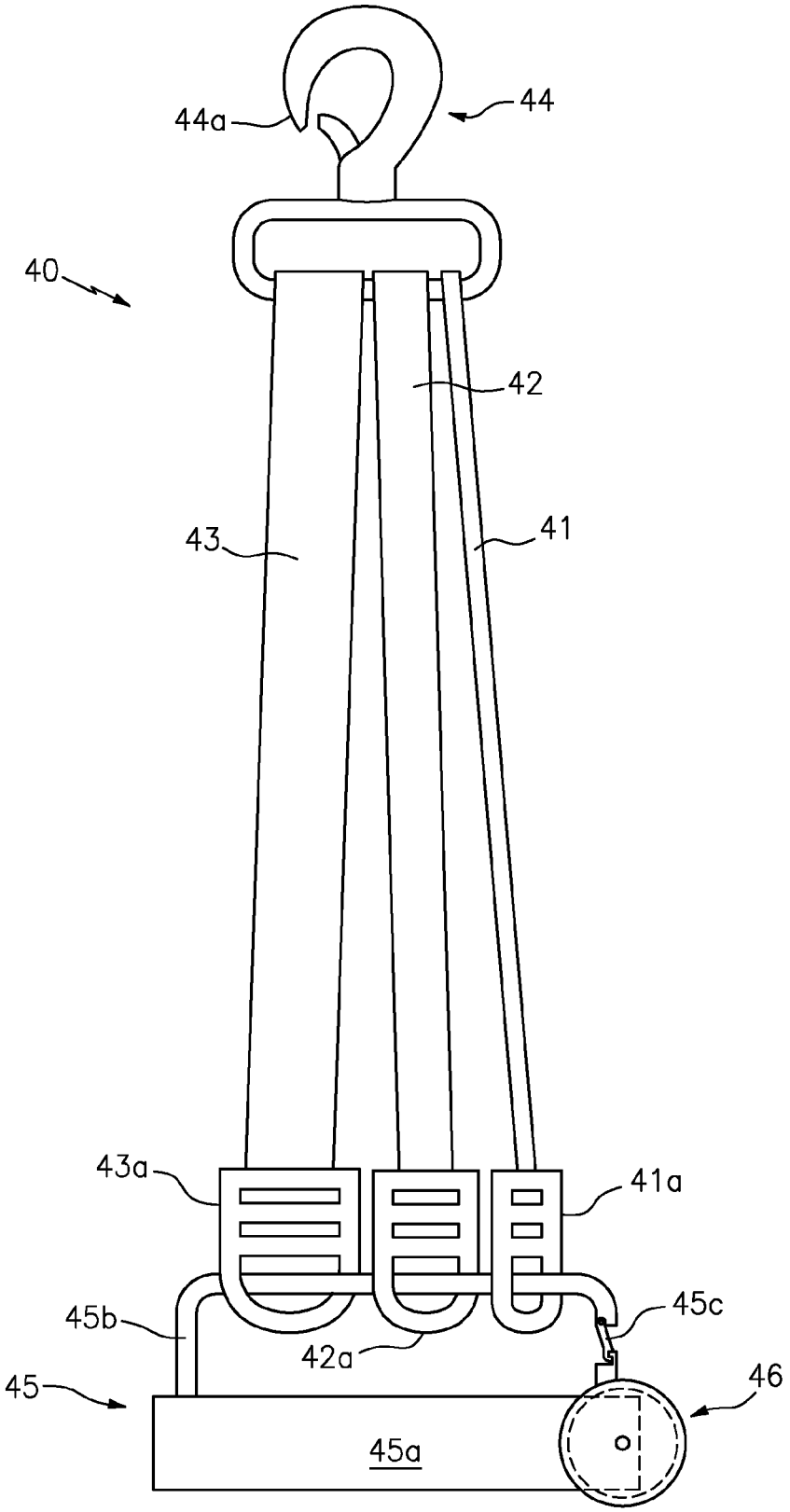
FIG. 4 is a front view of one of the resistance devices of the portable exercise system, in accordance with one embodiment of the invention.

FIG. 4 illustrates one embodiment of one of the resistance devices 40 of the system 10. As shown, each of the resistance devices can include a plurality of resistance bands 41-43 that are interposed between a frame connection member 44 and a handle 45.

As described herein, each of the resistance bands can be constructed from an elastomeric material having a known resistance when stretched. In this regard, it is preferred that the first member 41 include a ten pound pull resistance, the second member 42 include a twenty pound pull resistance, and the third member include a forty pound pull resistance. Of course, any number of members having any known construction material and pull resistance are also contemplated.

As shown, each of the resistance bands can be secured onto a frame connection member, such as the illustrated hook 44 in an octopus configuration. As shown, the hook can include a pointed section 44*a* which can be inserted into any one of the apertures 24 of the truss frame. In addition to the above, each of the resistance bands can also be positioned within a protective sleeve/cover 70 (see FIG. 7), in order to prevent the bands from tangling or injuring a user should a breakage occur.

As shown, the handle 45 can include a padded handgrip section 45*a* having a releasable strap 45*b* and retention member 45*c* secured thereon. The strap 45*b* can engage the clip/ring sections of the resistance bands 41*a*, 42*a* and 43*a*, respectively. Such a feature can function to allow each of the resistance bands to be used alone or in combination thereby creating a pull resistance of between 10 and 70 pounds, when the above described pull resistances are utilized. A small grooved rotating wheel 46 can be secured onto the end of the handgrip 45. As will be described below, the side edge of the frame 20 can be positioned within the grooved portion of the wheel, and the wheel can roll/glide up and down the truss as the exercise is performed.

Figure 5:
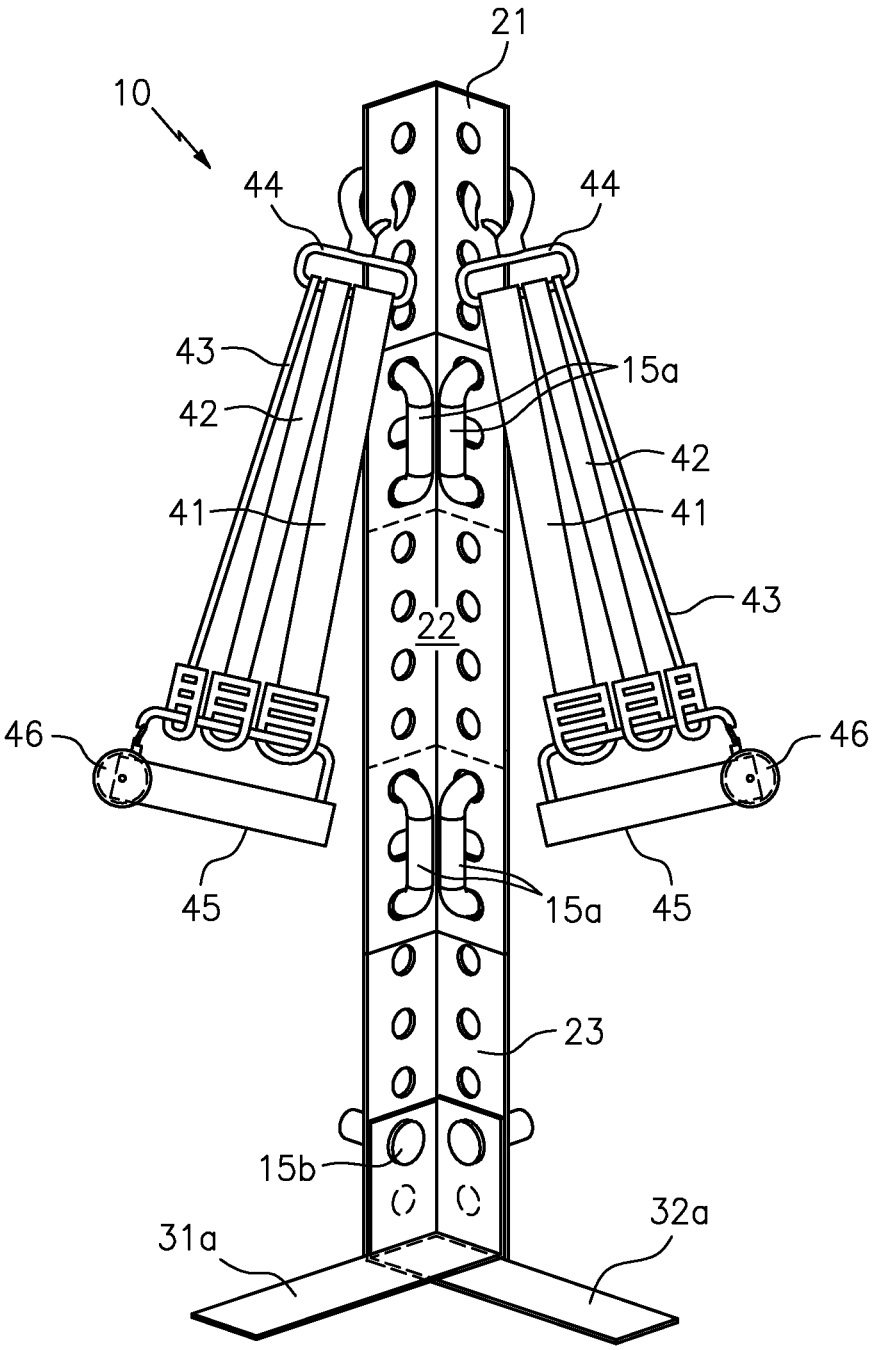
FIG. 5 is a perspective view of the assembled portable exercise system, in accordance with one embodiment of the invention.

FIG. 5 illustrates one embodiment of the assembled Training Truss system in the "V" configuration wherein each of the horizontal members 31*a* and 32*a* are not in line with one another. As shown, the hooks 44 can engage the apertures 24 of the frame and the device is ready to be used as described below.

Although described above as including certain components, those of skill in the art will recognize that any number of other items suitable for assisting a user to assemble and use the Training system can also be provided. Several such items are shown in FIG. 1, and include a carrying case 11, which can be constructed from any suitable material and can be utilized to transport the system components to and from any desirable location. A wrench 12 or other such tool can also be provided in order to allow a user to assemble and tighten the connection hardware 15*a* onto the frame members. One or more leg straps 13 can also be provided and can take the place of the above described handle 45, in order to engage the resistance bands and perform a thorough lower body/leg workout. Finally, any number of protective elements such as a rubber cap (not illustrated) or other such devices can also be provided in order to ensure user safety.

In operation, the System 10 can be used in a single handed mode or in a two handed (alternating arm mode). In the single handed mode, the truss allows a user to simulate all of the most basic exercises, by focusing on isolating a single arm or leg at a time. For example, a user could perform a set of right armed pull-ups, arm press, military press, rowing, arm curls, or arm extensions, immediately followed by a left armed set. The same method applies for leg presses, leg extensions, and simulated leg curls. The single handed mode has several advantages. In this mode the user isolates one arm at a time and experiences the comfort of the arm resting on the truss while the letting the handgrip slides smoothly back and forth along the truss rail. The other great advantage is that this configuration requires only one resistance element and therefore fits in a much smaller container for travel. In this mode, the user performs the exercises one arm at a time and stops to rest only after doing 3 or 4 sets consecutively.

In the two handed mode, the user uses both right and left resistance devices. The user alternates right and left arm movements for each repetition until the set is complete and then rests for short periods before performing the next set.

Configurations

As noted above, the base unit 30 can be secured to the truss frame in either a "V" or "T" configuration. The "V" configuration is preferred when using the system as a 2 handed rowing machine. The "T" configuration is preferred when using the system for chest presses and for single handed rowing exercises. In this case, the base unit is used to prop the truss against the corner of a room. For all other exercises the configuration is a matter of user preference. To change configurations one simply, removes the cotter pin 15*b* and disconnects the second bracket 32. Then user then reconnects the second bracket in the desired new position and reinserts the cotter pin.

Turning now to FIGS. 6-9, various exercises utilizing the Training Truss System 10 will be described. Of course, the following description is for demonstrative purposes only, as many other forms of exercises and uses are also contemplated.

Figure 6:
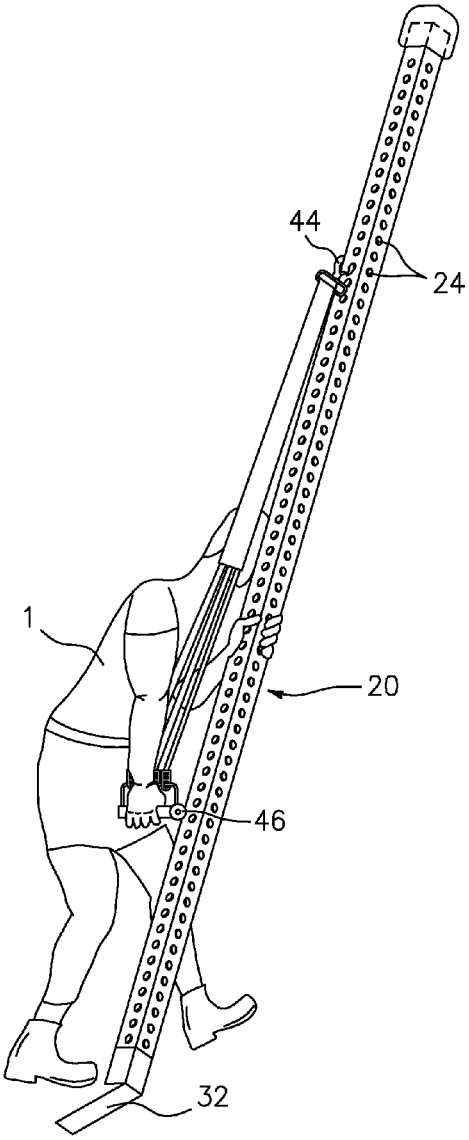
FIG. 6 is a side view of the portable exercise system in operation, in accordance with one embodiment of the invention.

Dip presses. As shown in FIG. 6, dips can be done in the vertical position by straddling the truss and pushing the handgrip downward. Utilizing the handgrip wheel 46, the user 1 can slide the wheel up and down the truss rail 20. In this regard, the wheel can function to maintain contact with the truss, thereby ensuring the user maintains perfect form throughout the exercise.

Figure 7:
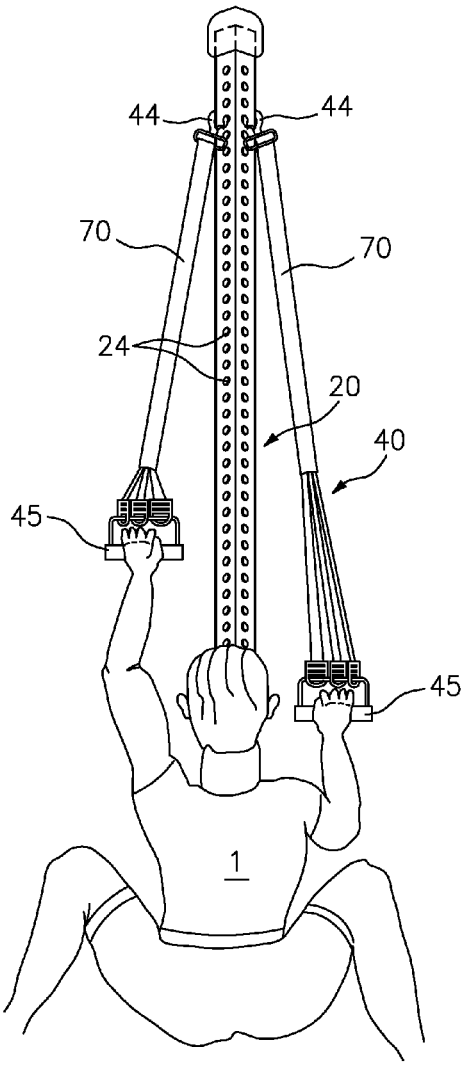
FIG. 7 is a front view of the portable exercise system in operation, in accordance with one embodiment of the invention.

Pull-ups: As shown in FIG. 7, two-handed alternating pull-ups can be performed in the vertical position. In this regard, the user 1 can connect both of the resistance devices 40 to the truss at identical locations N. Once the truss is positioned vertically on the floor, the user can sit on the horizontal members of the base unit, grab the handgrips 45 and pull.

Figure 8:
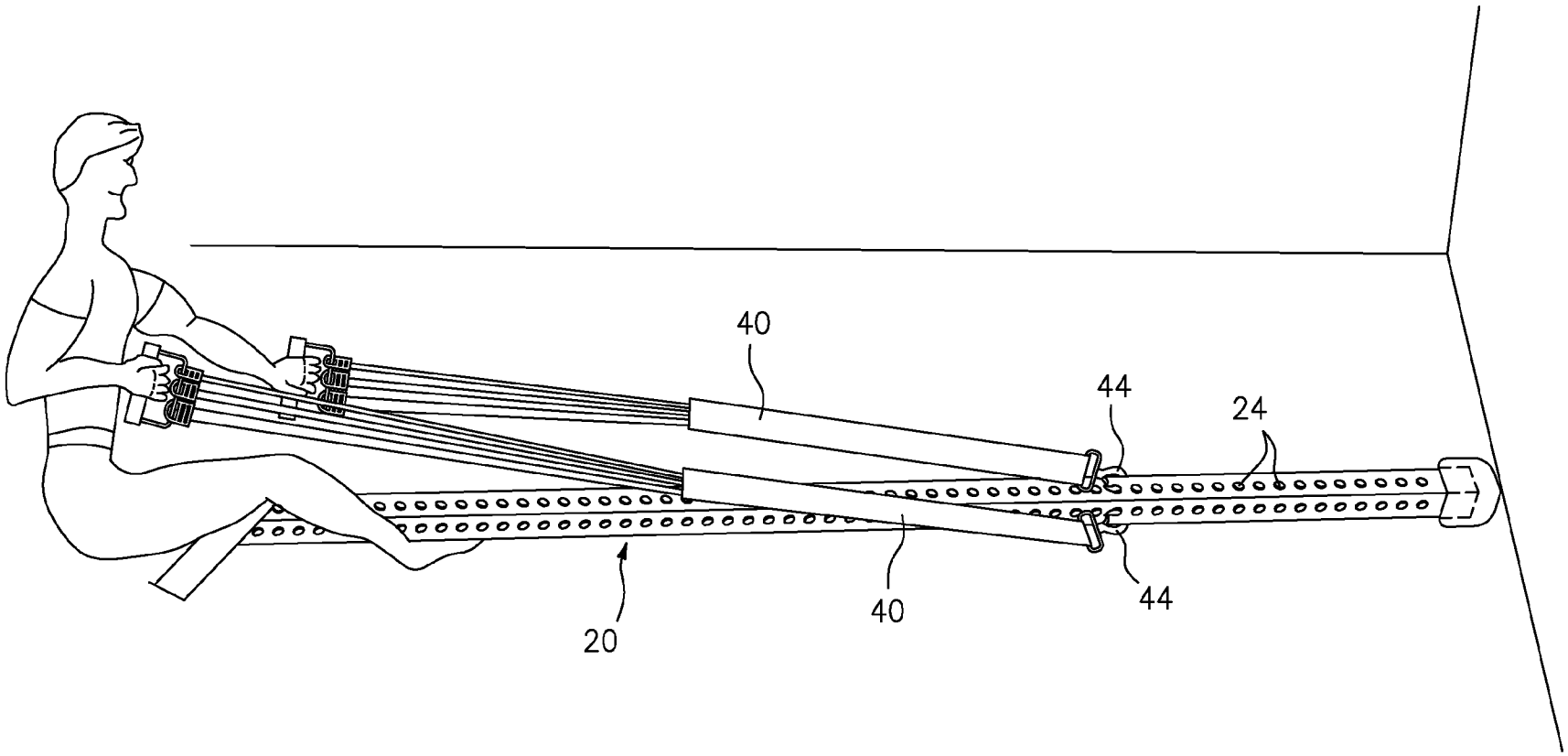
FIG. 8 is a perspective view of the portable exercise system in operation, in accordance with one embodiment of the invention.
Figure 9:
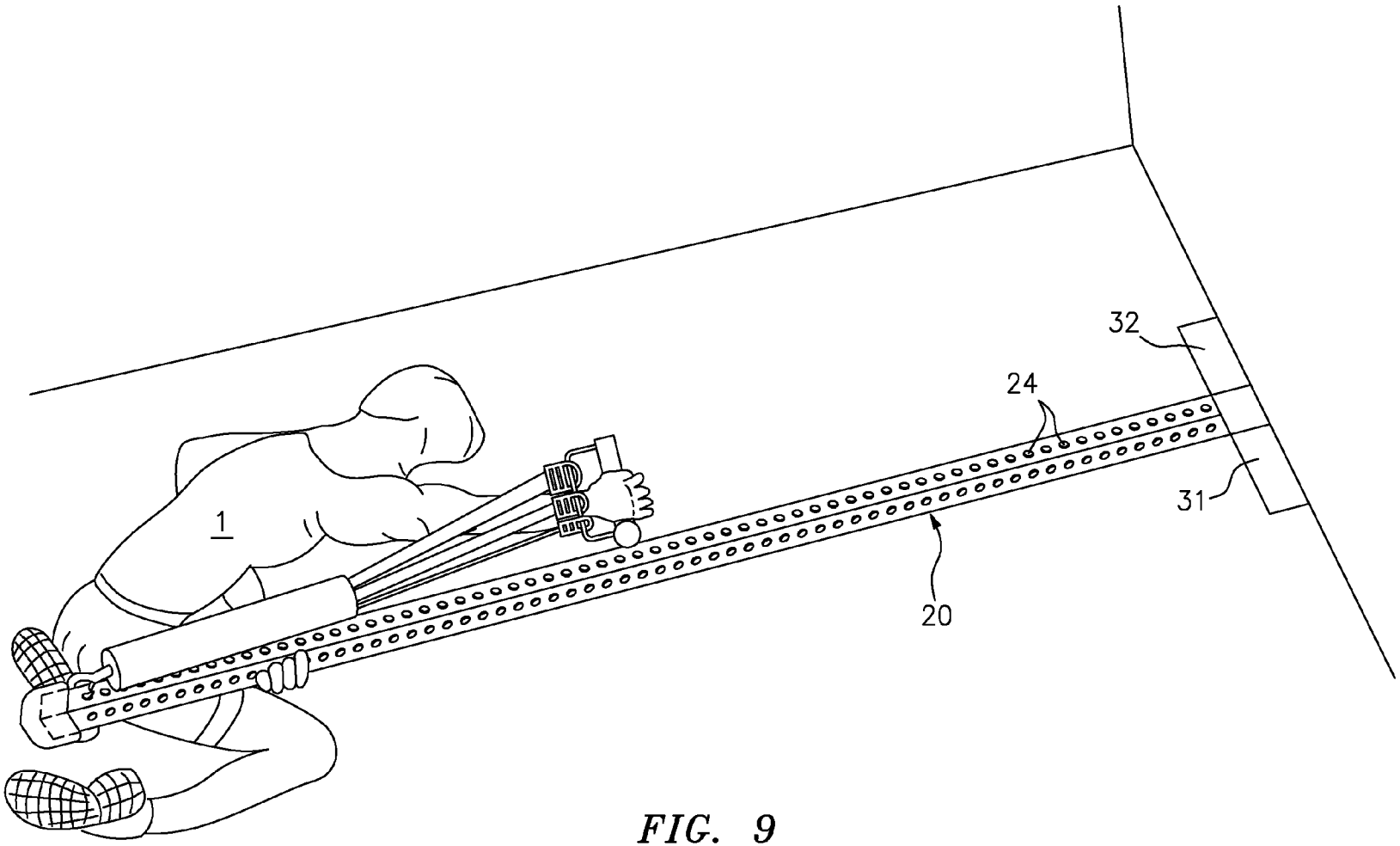
FIG. 9 is another perspective view of the portable exercise system in operation, in accordance with one embodiment of the invention.

Rowing exercise: As shown in FIG. 8, when the truss frame 20 is in the horizontal position and the base unit is in the "V" configuration, the truss becomes a rowing machine. In this regard, the user can straddle the truss frame and alternatively pull the resistance devices 40 with the right and left hand.

Arm and chest presses. As shown in FIG. 8, the truss frame 20 can be positioned in the "T" configuration, wherein the base unit 30 is positioned against a wall. At this time, the user can straddle the top portion of the truss frame, connect the resistance device(s) at the nearest aperture, and push.

Accordingly, the above described training truss system provides a fully portable exercise system capable of providing a complete body workout in a novel fashion.

As described herein, one or more elements of the system 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements may be formed together as a continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A portable exercise system, comprising:

a plurality of frame members that are securable in a linear relation to one another and collectively define a truss frame, and each of the plurality of frame members includes a plurality of apertures that are disposed along an entirety of a length thereof;

a base unit that functions to engage one of the frame members along a bottom end, said base unit being positionable in each of a T-shaped configuration and a V-shaped configuration, said base unit further comprising a first bracket having a horizontal section and a plurality of vertical sections forming a pocket area, and a second bracket having a horizontal section and a single vertical section, wherein the vertical sections of each of the first and second brackets include one or more apertures; and a pair of resistance devices, each of said devices including one or more resistance bands, a frame connection member, and a handle.

2. The system of claim 1, wherein each of the resistance devices includes three resistance bands, each having a different pull resistance.

3. The system of claim 2, wherein the handle further includes a releasable strap and retention member, said strap and retention member functioning to selectively engage and secure the resistance bands to the handle.

4. The system of claim 1, further comprising:

a pair of padded sleeves, each of said sleeves having a shape and size that is complementary to the horizontal sections of the first and second brackets.

5. The system of claim 1, further comprising:

a grooved rotating wheel that is positioned along one end of the handle, said wheel functioning to engage the truss frame and to glide along the length thereof.

6. The system of claim 1, further comprising:

a sleeve that is positionable about each of the resistance bands.

7. The system of claim 1, wherein the frame connection member includes a hook having a first end that functions to engage at least one of the frame apertures.

8. The system of claim 1, wherein each of said apertures includes a marking having one or both of a sequential number and a hardware connection symbol.

9. The system of claim 1, wherein the plurality of frame members consists of three frame members, and the system further includes a plurality of U bolts that function to secure each of the three frame members together sequentially.

10. The system of claim 1, wherein the plurality of frame members includes a top frame member, a bottom frame member, and a middle frame member, said middle frame member having a pair of generally rectangular shaped receivers that are positioned along a top and bottom edge thereof, wherein said receivers function to engage a top end of the bottom frame member, and a bottom end of the top frame member, respectively.

11. The system of claim 1, further comprising:

a carrying case for transporting the system components;

connection hardware for securing the frame members together;

a wrench for engaging the connection hardware; and a leg strap for engaging one of the resistance devices.

12. A portable exercise system, comprising:

a plurality of frame members that are securable in a linear relation to one another and collectively define a truss frame, and each of the plurality of frame members includes a plurality of apertures that are disposed along an entirety of a length thereof;

a base unit that functions to engage one of the frame members along a bottom end, said base unit being positionable in each of a T-shaped configuration and a V-shaped configuration;

a pair of resistance devices, each of said devices including one or more resistance bands, a frame connection member, and a handle; and a grooved rotating wheel that is positioned along one end of the handle, said wheel functioning to engage the truss frame and to glide along the length thereof.

* * * * *